US010689859B2

(12) United States Patent
Duranleau

(10) Patent No.: US 10,689,859 B2
(45) **Date of Patent: *Jun. 23, 2020**

(54) CONCEALED CLADDING FIXATION SYSTEM

(71) Applicant: Acculign Holdings, Inc., Wilmington, DE (US)

(72) Inventor: André Duranleau, Portland, OR (US)

(73) Assignee: Acculign Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/429,504

(22) Filed: Jun. 3, 2019

(65) Prior Publication Data

US 2019/0284817 A1 Sep. 19, 2019

Related U.S. Application Data

(63) Continuation of application No. 15/907,150, filed on Feb. 27, 2018, now Pat. No. 10,309,112.

(60) Provisional application No. 62/464,861, filed on Feb. 28, 2017.

(51) Int. Cl.

| | |
|---|---|
| ***E04F 13/25*** | (2006.01) |
| ***E04F 13/23*** | (2006.01) |
| ***E04B 2/72*** | (2006.01) |
| ***E04B 1/41*** | (2006.01) |
| ***E04F 13/08*** | (2006.01) |
| ***E04B 1/38*** | (2006.01) |

(52) U.S. Cl.

CPC ..... *E04F 13/25* (2013.01); *E04B 1/40* (2013.01); *E04B 2/721* (2013.01); *E04F 13/083* (2013.01); *E04F 13/0808* (2013.01); *E04F 13/23* (2013.01); *E04B 2001/405* (2013.01)

(58) Field of Classification Search

CPC ..... E04F 13/25; E04F 13/083; E04F 13/23; E04B 1/40; E04B 2/721

See application file for complete search history.

(56) References Cited

U.S. PATENT DOCUMENTS

| | | | |
|---|---|---|---|
| 2,910,121 | A | 10/1959 | Stern et al. |
| 5,158,392 | A | 10/1992 | Takeda |
| 5,191,745 | A | 3/1993 | Story |
| 5,368,267 | A | 11/1994 | Howard |
| 5,555,689 | A | 9/1996 | Gilmore |
| 5,586,811 | A | 12/1996 | Tonero |

(Continued)

FOREIGN PATENT DOCUMENTS

| | | | |
|---|---|---|---|
| CN | 101878341 | A | 11/2010 |
| CN | 201762935 | U | 3/2011 |

(Continued)

*Primary Examiner* — Brian D Mattei

(74) *Attorney, Agent, or Firm* — Kolitch Romano LLP

(57) ABSTRACT

A system for mounting wall panels to a wall frame or other surface, and methods for assembling and using such a system. The disclosed system may include a plurality of mounting brackets, an adjustable wall panel support mechanism coupled to the mounting brackets, and a wall panel attachment member such as a hook plate. The position and orientation of the wall panel attachment member relative to the mounting brackets may be precisely adjusted, allowing fine adjustments in the position and orientation of a wall panel after the wall panel has been installed.

20 Claims, 11 Drawing Sheets

(56) References Cited

U.S. PATENT DOCUMENTS

| | | | | |
|---|---|---|---|---|
| 5,846,018 | A | 12/1998 | Frobosilo et al. | |
| 6,554,242 | B2 | 4/2003 | Kim | |
| 7,048,244 | B2 | 5/2006 | Hauck | |
| 7,175,146 | B2 | 2/2007 | Kim | |
| 7,270,309 | B2 | 9/2007 | Burns et al. | |
| 7,494,099 | B2 | 2/2009 | Shin | |
| 7,753,332 | B2 | 7/2010 | O'Keene | |
| 7,819,369 | B2 | 10/2010 | Larossa | |
| 7,891,622 | B1 | 2/2011 | O'Keene | |
| RE43,696 | E | 10/2012 | Graham | |
| 8,333,355 | B2 | 12/2012 | Stifal et al. | |
| 8,683,749 | B2 | 4/2014 | Fontes et al. | |
| 8,746,642 | B2 | 6/2014 | Molter | |
| 8,783,633 | B2 | 7/2014 | Truckor | |
| 8,939,416 | B2 | 1/2015 | Duranleau | |
| 9,074,375 | B2 | 7/2015 | Duranleau | |
| 9,376,808 | B2 | 6/2016 | Duranleau | |
| 9,435,127 | B2 | 9/2016 | Stoyanov | |
| 9,469,999 | B1 | 10/2016 | Aboukhalil | |
| 9,574,345 | B2 | 2/2017 | Duranleau | |
| 9,803,373 | B2 | 10/2017 | Duranleau | |
| 9,896,840 | B2 | 2/2018 | Ting | |
| 9,915,074 | B2 | 3/2018 | Duranleau | |
| 10,309,112 | B2 * | 6/2019 | Duranleau | E04F 13/25 |
| 2002/0124514 | A1 | 9/2002 | Higgins | |
| 2003/0188500 | A1 | 10/2003 | Voegele | |
| 2005/0056749 | A1 | 3/2005 | Simard | |
| 2006/0006296 | A1 | 1/2006 | Morita | |
| 2006/0249633 | A1 | 11/2006 | Korczak et al. | |
| 2007/0007413 | A1 | 1/2007 | Jung et al. | |
| 2007/0199275 | A1 | 8/2007 | Kurz | |
| 2010/0219315 | A1 | 9/2010 | Muday et al. | |
| 2013/0186031 | A1 | 7/2013 | Ting | |
| 2014/0059973 | A1 | 3/2014 | Duranleau | |
| 2015/0096251 | A1 | 4/2015 | McCandless et al. | |
| 2015/0096259 | A1 | 4/2015 | Duranleau | |
| 2015/0167314 | A1 | 6/2015 | Stoyanov | |
| 2015/0308107 | A1 | 10/2015 | Duranleau | |
| 2016/0053494 | A1 | 2/2016 | White et al. | |
| 2016/0120309 | A1 | 5/2016 | Brandt et al. | |
| 2017/0241133 | A1 | 8/2017 | Ting | |
| 2017/0362816 | A1 | 12/2017 | Carbary et al. | |

FOREIGN PATENT DOCUMENTS

| | | | |
|---|---|---|---|
| GB | 827838 | A | 2/1960 |
| JP | 08-184153 | A | 7/1996 |
| JP | 09-195686 | A | 7/1997 |
| JP | 10-317550 | A | 12/1998 |
| JP | 2005-307656 | A | 11/2005 |
| KR | 10-1002354 | B1 | 12/2010 |

* cited by examiner

CONCEALED CLADDING FIXATION SYSTEM

FIELD

The present disclosure is generally directed to wall panel fixation and adjustment systems. More specifically, the disclosure is directed to systems for installing and adjusting the positions and orientations of building wall panels, and methods of manufacturing, assembling and using such systems.

INTRODUCTION

Building construction, particularly commercial building construction, often involves mounting pre-fabricated wall panels, sometimes referred to as cladding, to the exterior and/or interior of the building. When such panels are used, they must be properly aligned with each other and also with the other portions of the building, such as the wall frame to which the panels are attached, or any other suitable architectural component of the building. Making precise adjustments in the orientation and position of a wall panel is therefore important, but can be challenging. For example, many panel adjustment systems require physical access to the back side of the panel. Others require the panel to be removed and then reinstalled after adjustments are made to the mounting hardware.

One solution to the above problems is described in U.S. Pat. Nos. 8,939,416, 9,074,375, 9,376,808, 9,574,345, 9,803,373 and 9,915,074 (to issue Mar. 13, 2018), each of which is hereby incorporated by reference. This solution involves attaching a fixed rectangular outer casing to the wall frame, nesting a movable rectangular component at least partially within (or outside) the fixed component, and attaching a wall panel to the movable component through a hook plate. Adjustment members, accessible from a top side of the panel, extend downward and can be rotated manually to make separate inward and outward adjustments of the top and bottom portions of the panel, as well as overall vertical adjustments of the panel. However, this system still suffers from various potential drawbacks. For example, the fixed and movable components take the form of rectangular casings, which can be bulky and heavy to manipulate, and relatively expensive to manufacture and ship. In addition, the rectangular form of the casings prevents the installation of insulation where the casings are disposed behind the panels, leaving uninsulated portions of the wall.

Accordingly, there is a need for a wall panel adjustment system which retains the advantages known in the prior art, but is potentially lighter, less bulky, less expensive to manufacture and ship, and allows insulation to extend substantially across the entirety of the wall space behind the panels.

SUMMARY

The present disclosure provides systems for mounting wall panels to wall frames which allow precise manual adjustments in the position and orientation of the panels manually, using easily accessible adjustment members. The present disclosure also describes methods for manufacturing and using such systems.

According to aspects of the present disclosure, wall panel mounting systems may include mounting brackets, each including a wall mounting portion defining a plane and configured to be fixed to a wall frame, and a pair of opposing parallel members extending perpendicularly away from the plane of the wall mounting portion and defining a narrow receiving channel. This narrow receiving channel, which in some cases may be a single, planar, rigid receiving member rather than a channel formed by opposing members, allows insulation to extend right up to the sides of the narrow channel (or planar receiving member), thereby avoiding any significant lack of desired insulation behind the panels that will be mounted. The mounting brackets used for a particular panel are configured to be installed in vertical alignment with each other.

The disclosed systems also may include an adjustable wall panel support mechanism including an elongated body portion having a planar member configured to fit within the receiving channels of the mounting brackets, with the planar member sandwiched between the opposing parallel members. When just a single planar receiving member is used instead of a receiving channel, the planar member of the body portion is configured to sit flush against the receiving member in direct abutment.

The disclosed systems also may include a top plate configured to be rigidly attached to one end of the body portion, a first elongated adjustment member passing through a first aperture in the top plate and extending toward the first mounting bracket, a first coupling bracket attached in threaded engagement with the first adjustment member and attached in unthreaded engagement with the first mounting bracket, a second elongated adjustment member passing through a second aperture in the top plate and extending toward the second mounting bracket, a second coupling bracket attached in threaded engagement with the second adjustment member and attached in unthreaded engagement with the second mounting bracket, and one or more wall panel attachment members operatively coupled to the body portion and configured to support a wall panel.

The components described above may be configured so that rotation of the first adjustment member causes the body portion of the wall panel support mechanism to move toward or away from the plane defined by the wall mounting portion of the first mounting bracket, and rotation of the second adjustment member causes the body portion to move toward or away from the plane defined by the wall mounting portion of the second mounting bracket. In other words, when a wall panel is installed and coupled to the wall panel attachment members, rotation of each adjustment member will cause an associated portion of the wall panel to move in or out toward the wall frame. In this manner, the tilt of the panel may be adjusted to give the panel a desired orientation, such as vertical.

In some embodiments, a vertical adjustment member may pass through the top plate and be connected to the wall panel attachment member by threaded engagement, wherein rotation of the vertical adjustment member causes the wall panel attachment member to move parallel to the planes defined by the wall mounting portions, and is thereby configured to cause a mounted wall panel to move vertically up or down relative to the wall frame.

In some embodiments, the wall panel attachment member may be a hook plate, wherein the vertical adjustment member is attached to the hook plate in threaded engagement, the body portion is attached to the hook plate in sliding engagement, and z-clips or other wall panel mounting hardware is attached to the hook plate for receiving and retaining a wall panel.

In some embodiments, the wall mounting portion of each mounting bracket extends symmetrically away from the opposing parallel members, thereby defining T-shaped mounting brackets. In other embodiments, each wall mounting portion extends away from the opposing parallel members by different distances on each side of the opposing parallel members, thereby defining L-shaped mounting brackets. For example, L-shaped mounting brackets could be installed in building corners, or simply used in place of T-shaped brackets to save materials and manufacturing costs.

In some embodiments, each coupling bracket includes an elongated female-threaded aperture for receiving a male-threaded portion of the corresponding adjustment member, and a coupling bracket extending between the female-threaded aperture and one of the parallel members of the corresponding mounting bracket, and wherein the coupling bracket is attached to the parallel member by a pin passing through a circular aperture in the coupling bracket and also passing through a diagonal, elongated slot in the parallel member. In other cases, the coupling brackets could include elongated, male-threaded protrusions, and the corresponding adjustment members could be female-threaded hollow tubes.

Due to the coupling through the diagonal slot, rotation of one of the adjustment members attached to a coupling bracket causes the coupling bracket to move in a diagonal path relative to the associated mounting bracket, allowing inward and outward adjustments of the coupling brackets and thus of different portions of an installed wall panel. Overall vertical adjustments, without any inward or outward motion, may be made by the vertical adjustment member described previously.

Various other features of systems and methods according to the present teachings are described in this disclosure. Features, functions, and advantages may be achieved independently in various embodiments of the present disclosure, or may be combined in yet other embodiments, further details of which can be seen with reference to the following description and drawings.

DESCRIPTION

Overview

Figure 1:
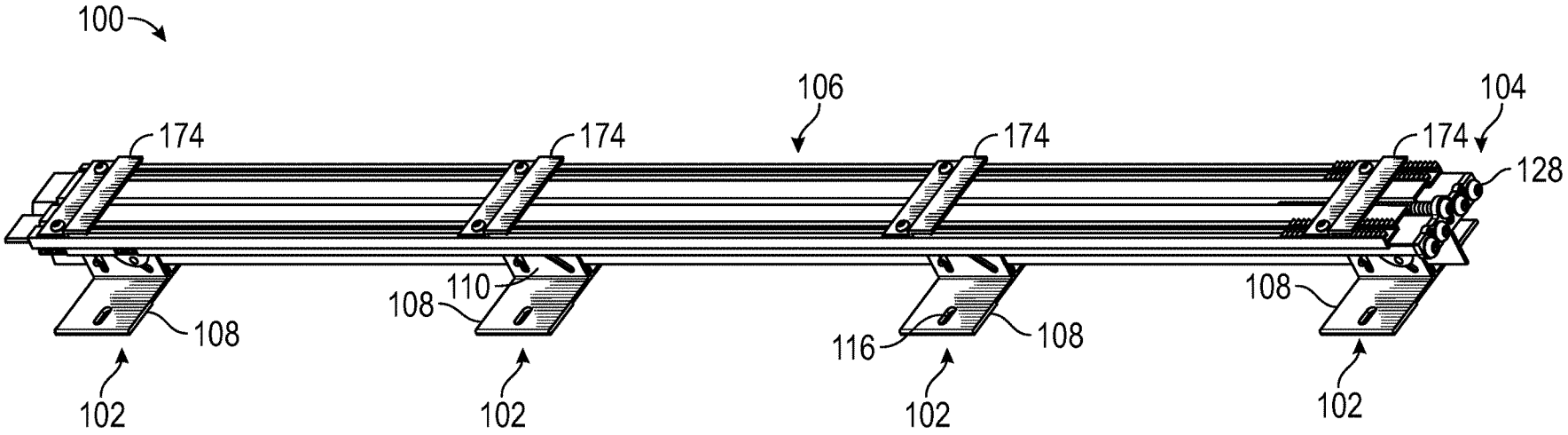
FIG. 1 is a perspective view of an embodiment of a system for mounting a wall panel to a wall frame, according to aspects of the present disclosure.
Figure 2:
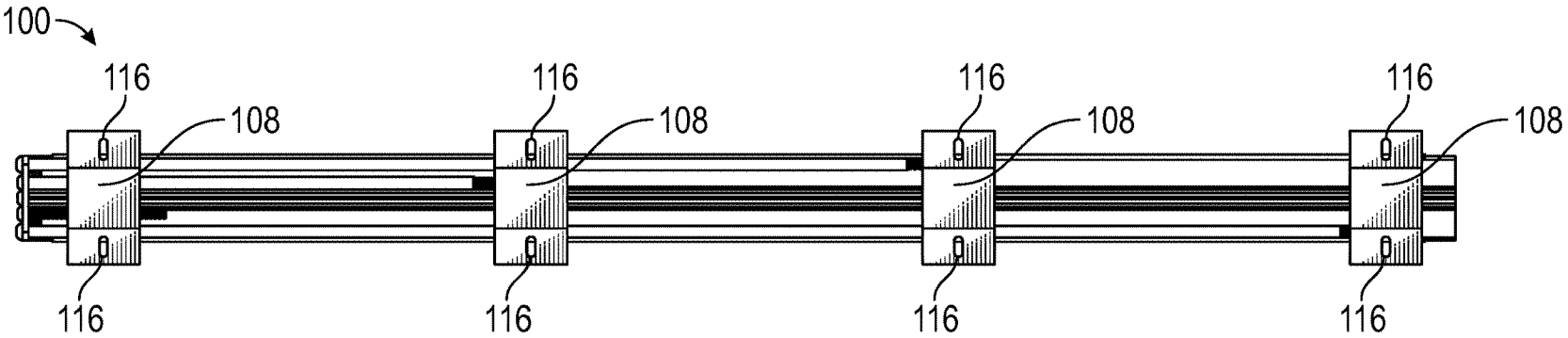
FIG. 2 is a rear elevational view of the system of FIG. 1.
Figure 3:
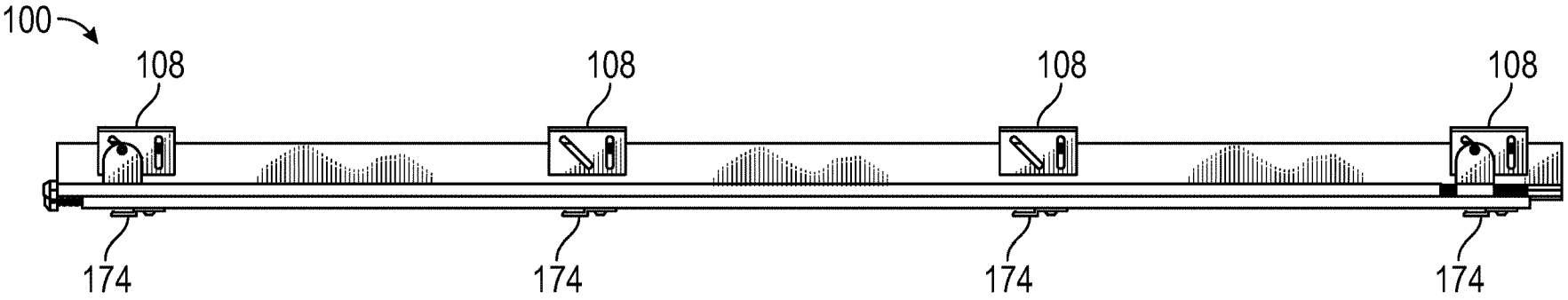
FIG. 3 is a right side elevational view of the system of FIG. 1
Figure 4:
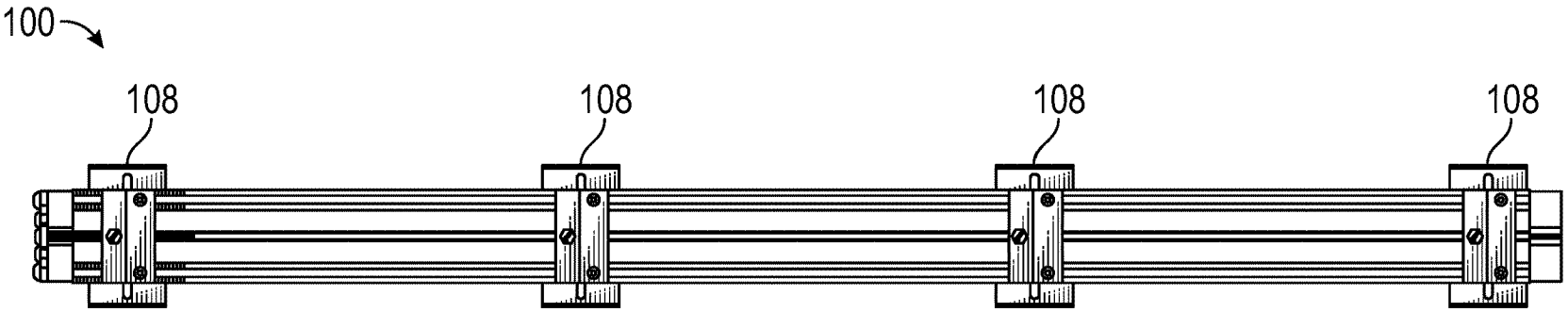
FIG. 4 is a front elevational view of the system of FIG. 1.
Figure 5:
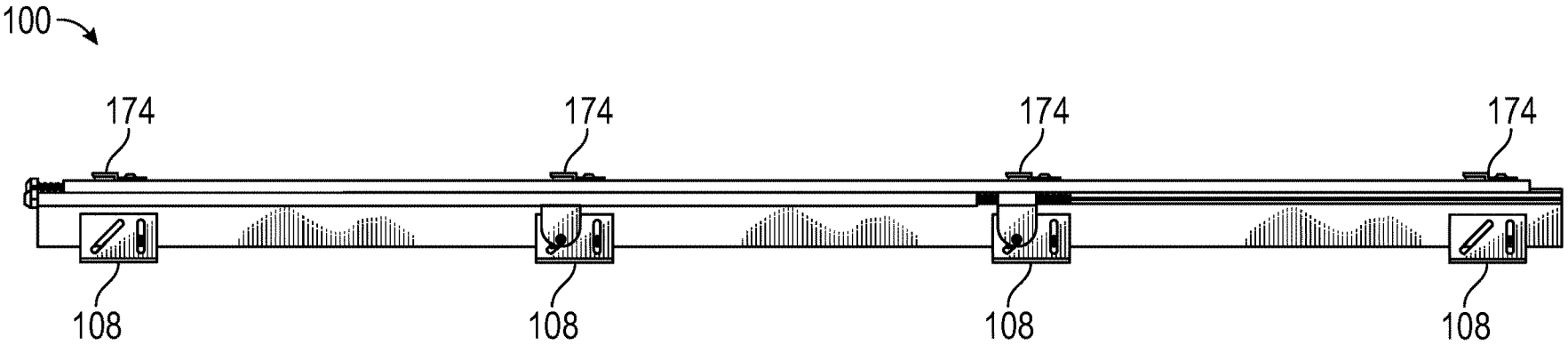
FIG. 5 is a left side elevational view of the system of FIG. 1.
Figure 6:
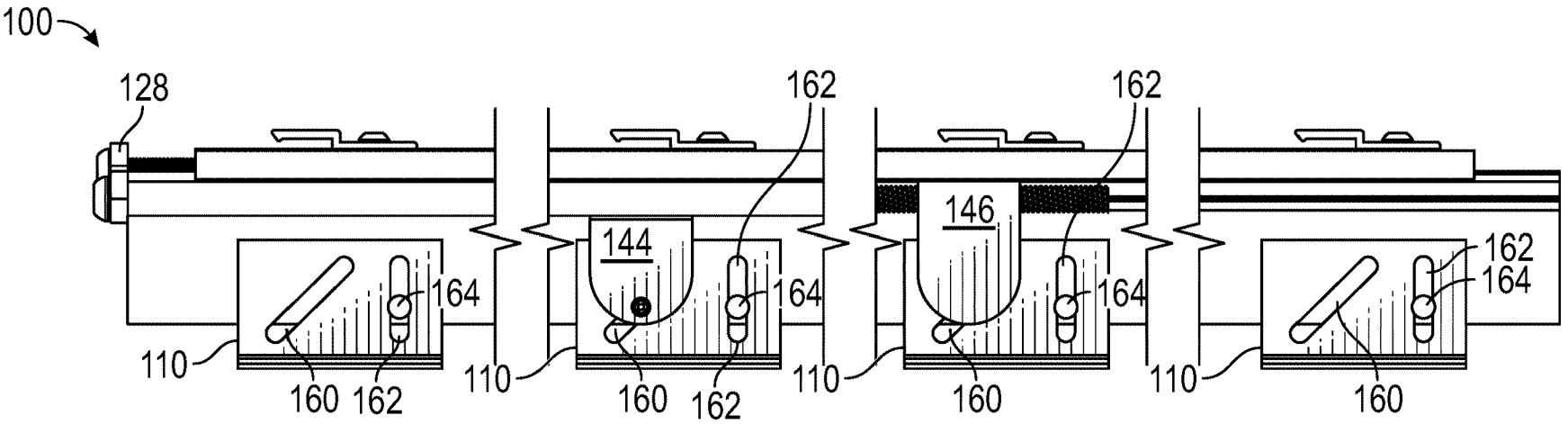
FIG. 6 is a magnified view of portions of the left side elevational view of FIG. 5, with other portions cut away.

Various embodiments of a system for mounting a wall panel to a wall frame allowing fine manual adjustments of the position and orientation of the wall panel are described below and illustrated in the associated drawings. Unless otherwise specified, the disclosed system and/or its various components may, but are not required to, contain at least one of the structure, components, functionality, and/or variations described, illustrated, and/or incorporated herein. Furthermore, the structures, components, functionalities, and/or variations described, illustrated, and/or incorporated herein in connection with the present teachings may, but are not required to, be included in other similar systems. The following description of various embodiments is merely exemplary in nature and is in no way intended to limit the disclosure, its application, or uses. Additionally, the advantages provided by the embodiments, as described below, are illustrative in nature and not all embodiments provide the same advantages or the same degree of advantages.

Wall panel mounting systems according the present teachings generally include mounting brackets for attaching the system to a wall frame, and an adjustable wall panel support mechanism, operatively connected to the mounting brackets, which is configured to support a wall panel and to be have an adjustable position and orientation relative to the mounting brackets.

Definitions

"Defining a plane" means that one or more portions of an object's surface lie within a common plane, which is thereby defined by those portions.

"Elongated" means significantly longer in one dimension than another.

"Planar" means flat when applied to a surface or a portion of an object, and means having closely separated, parallel flat surfaces when applied to a member or three-dimensional object.

"Threaded engagement" means screw-like engagement wherein an externally threaded object engages with an internally threaded object.

"Unthreaded engagement" means any type of connection or engagement other than threaded engagement.

"Wall frame" means any interior or exterior architectural component capable of supporting a wall panel.

"Wall panel" means any panel-type building finish, regardless of orientation or function. For example, wall panels can be mounted at any orientation, including horizontally (such as on a ceiling), and may have any size, weight, or decorative properties.

Examples, Components, and Alternatives

The following sections describe selected aspects of exemplary wall panel mounting system embodiments as well as related systems and/or methods. The examples in these sections are intended for illustration and should not be interpreted as limiting the entire scope of the present disclosure. Each section may include one or more distinct inventions, and/or contextual or related information, function, and/or structure.

Example 1

This example describes a first embodiment of a wall panel mounting system according to the present teachings, as depicted in FIGS. 1-12 and generally indicated at 100.

System 100 includes four mounting brackets, each generally indicated at 102. More generally, any desired number of mounting brackets may be used, although two or more brackets will typically be used to provide stability. Furthermore, while mounting brackets 102 are shown as discrete structures of a particular size, in general the mounting brackets may have any desired size, and in some cases a continuous structure providing the same function may be used in place of the discrete mounting brackets. For example, mounting brackets 102 could be connected with rails or in some other fashion, thus forming a continuous structure without changing the function of the mounting brackets. When a longer or continuous mounting bracket is used, the system may be sufficiently stable even with just a single mounting bracket.

System 100 also includes an adjustable wall panel support mechanism, generally indicated at 104, and a wall panel attachment member, which in this example takes the form of a hook plate, generally indicated at 106. The structure and function of mounting brackets 102, wall panel support mechanism 104, and hook plate 106 will be described in more detail below.

Figure 9:
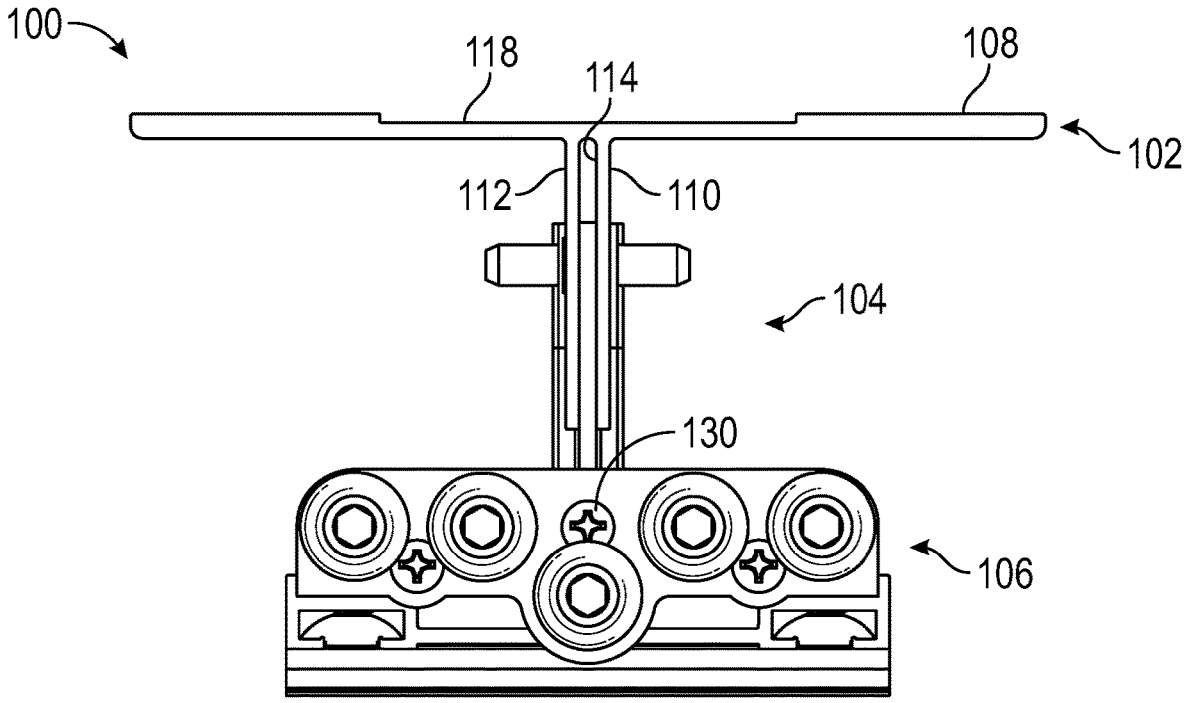
FIG. 9 is a top elevational view of the system of FIG. 1.
Figure 10:
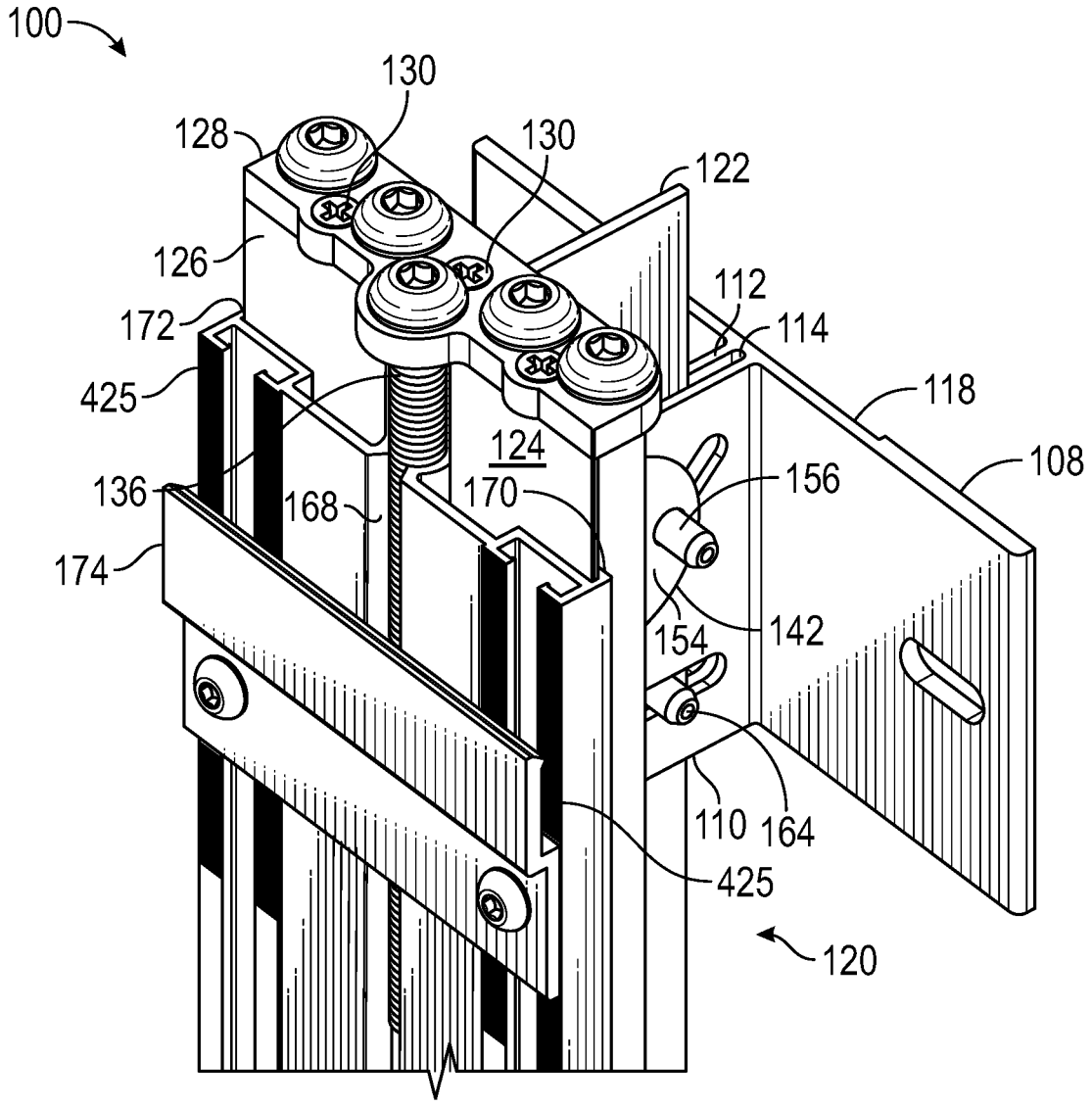
FIG. 10 is a magnified right side perspective view of a top portion of the system of FIG. 1.
Figure 12:
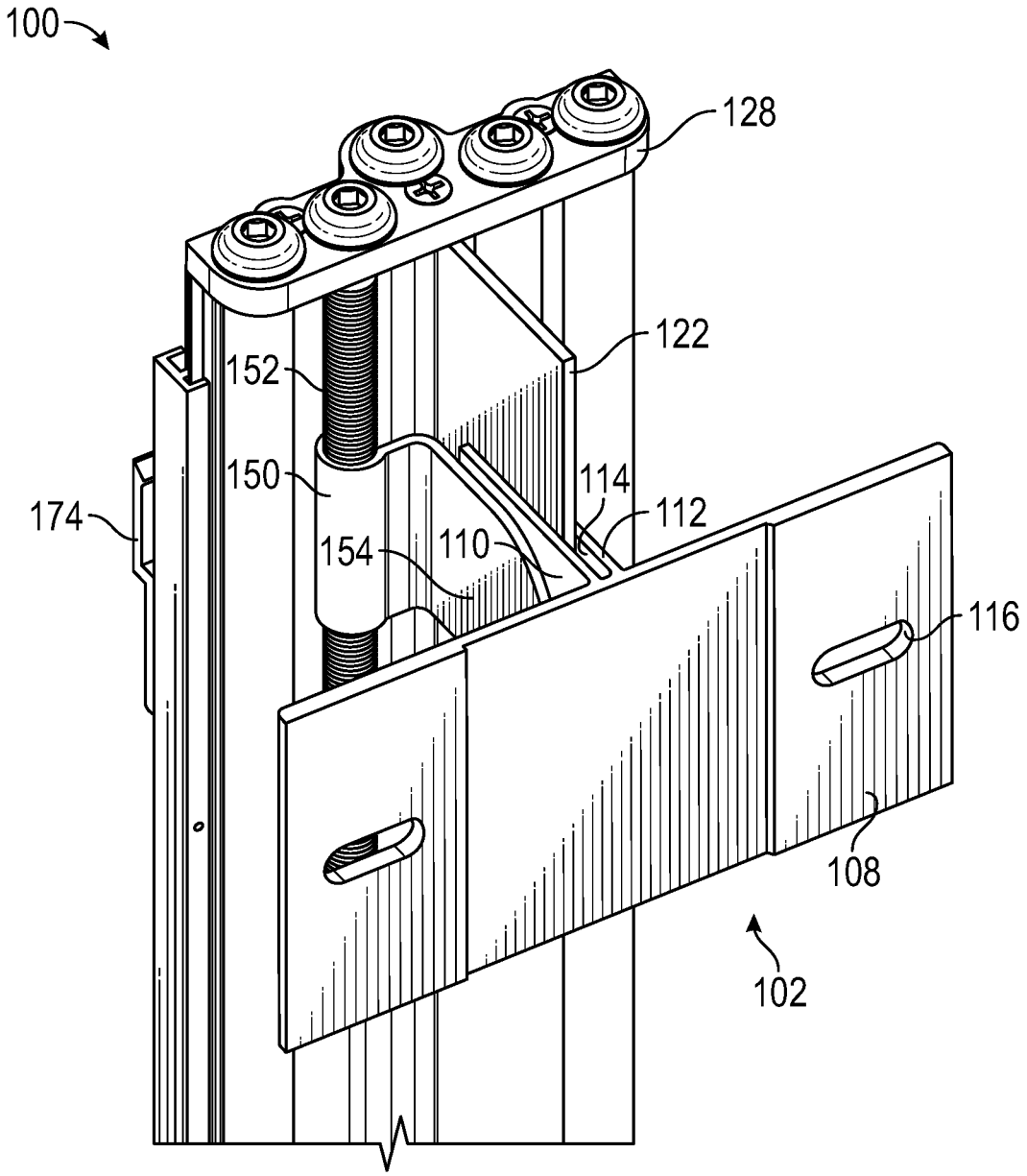
FIG. 12 is a magnified left side perspective view of a top portion of the system of FIG. 1.

Mounting brackets 102 each include a wall mounting portion 108 defining a plane and configured to be fixed to a wall frame, and a pair of opposing parallel members 110, 112 extending perpendicularly away from the plane of the wall mounting portion and defining a narrow receiving channel 114 between parallel members 110, 112 (e.g., see FIGS. 9, 10 and 12). Apertures 116 are formed in wall mounting portion 108 to facilitate the attachment of the mounting brackets to a wall frame or other desired surface. These apertures can take any desired shape and size.

As seen, for example, in FIG. 12, the wall mounting portions of mounting brackets 102 each extend symmetrically away from the opposing parallel members, thereby defining T-shaped mounting brackets, although other shapes are possible and may be preferable in some cases. For example, an L-shaped mounting bracket may be preferable for installation in the corner of a room, i.e., where two walls meet. A thermal break 118 is formed along the otherwise planar back surface of wall mounting portion 108 (e.g., see FIGS. 9 and 12). While not required, this thermal break can reduce undesirable heat transfer between system 100 and the wall frame. In some cases, thermal break 118 may be filled with an insulating material, such as a thermoplastic material (not shown).

Adjustable wall panel support mechanism 104 includes an elongated body portion, generally indicated at 120. The length of body portion 120 will generally be chosen to accommodate a desired number of mounting brackets, and to support a wall panel of particular dimensions. In some cases, body portion 120 may start as an extruded structure (e.g., formed of extruded aluminum), and then cut to either custom or standard lengths. Body portion 120 has a longitudinal planar, fin-like member 122 configured to fit within the receiving channels 114 of mounting brackets 102, with the planar member sandwiched between the opposing parallel members 110, 112 that define each of the receiving channels. See, e.g., FIGS. 9-12. Body portion 120 also has a pair of side portions 124, 126 extending in opposite directions perpendicular to planar member 122. As described in more detail below, planar member 122 and side portions 124, 126 of body portion 120 provide an interface between mounting brackets 102 and hook plate 106.

Wall panel support mechanism 104 also includes a top plate 128, which is configured to be rigidly attached to one end of body portion 120. See, e.g., FIGS. 9-12. Screws 130 or other fasteners may be used to fasten top plate 128 to body portion 120 by threading into complementary apertures (not shown) formed in the top of body portion 120.

Wall panel support mechanism 104 also includes a plurality of adjustment members passing through apertures in top plate 128. In the embodiment of this example, five such adjustment members 132, 134, 136, 138, 140 are shown. In general, as described in more detail below, one of the adjustment members will be used for vertical adjustment of the hook plate, and each of the remaining adjustment members will be used for inward and outward adjustments of the wall panel support mechanism with respect to the various mounting brackets 102. Therefore, in this example where four mounting brackets 102 are used, five adjustment members are shown.

In other embodiments where a different number of mounting brackets are used, there will be a correspondingly different number of adjustment members. For instance, if two mounting brackets are used, three adjustment members will be used. Although the embodiment of FIGS. 1-12 shows a top plate that can accommodate a total of five adjustment members, this number could easily be increased. The present teachings contemplate using any desired number of adjustment members. Each adjustment member passes through an aperture in top plate 128, and extends toward an associated one of the mounting brackets 102. This can be seen, for example, in the sectional view of FIG. 8.

Wall panel support mechanism 104 further includes four coupling brackets, generally indicated at 142, 144, 146, 148. These can be seen, for example, in FIGS. 6-8, and closer views of coupling bracket 142 can be seen, for example, in FIGS. 10-12. Each of the coupling brackets is attached in threaded engagement with a corresponding one of the adjustment members, and in unthreaded engagement with the corresponding mounting bracket.

Figure 7:
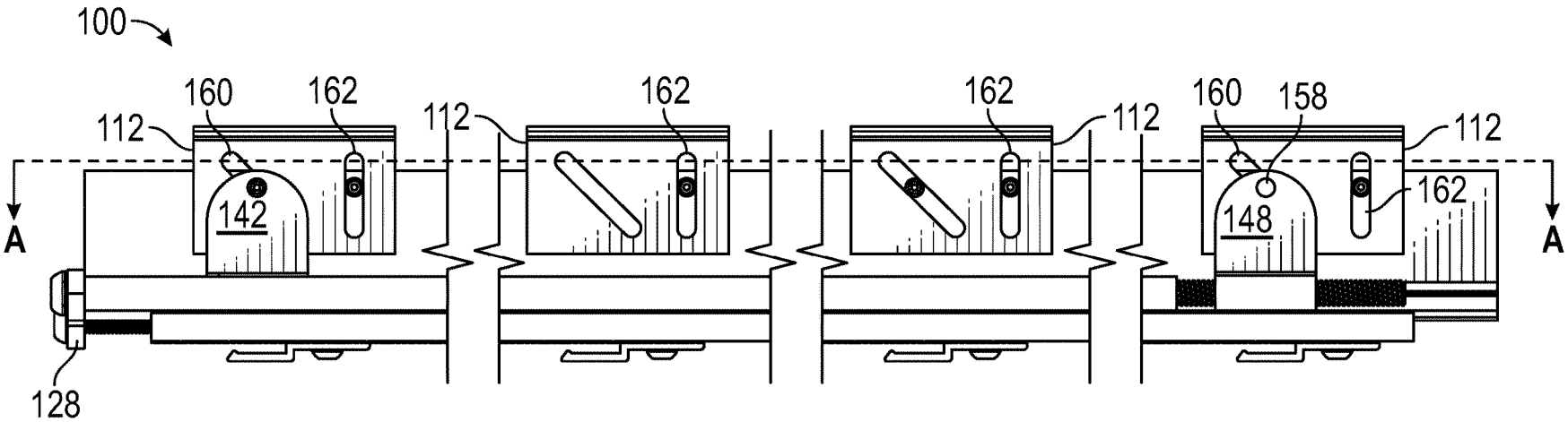
FIG. 7 is a magnified view of portions of the right side elevational view of FIG. 3, with other portions cut away.
Figure 8:
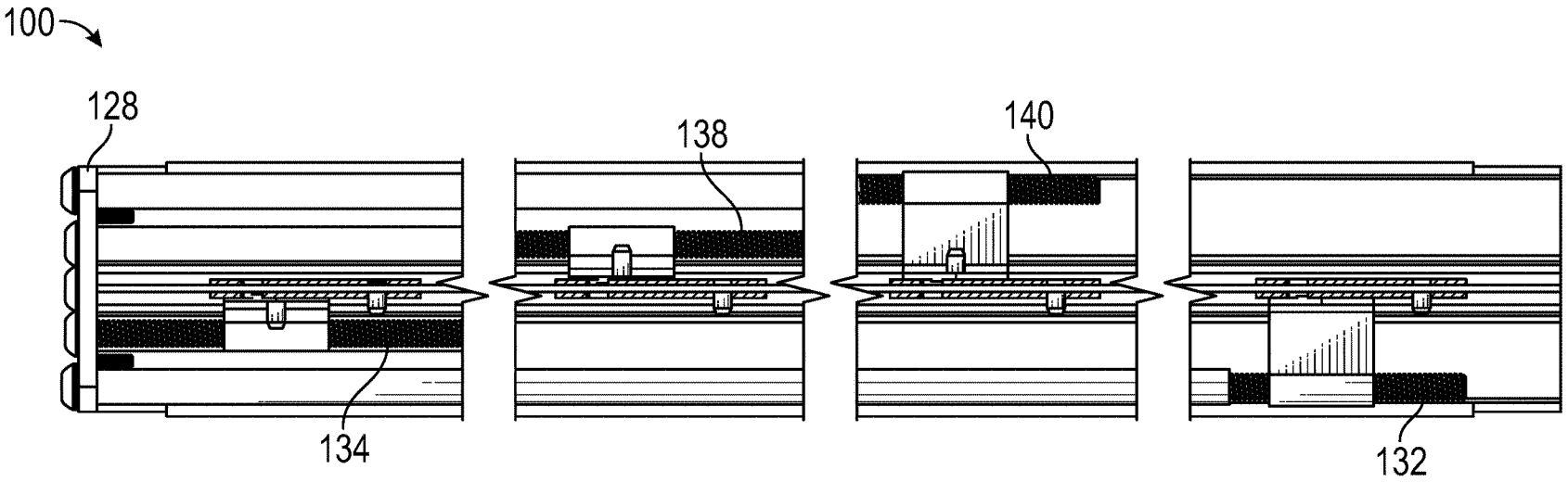
FIG. 8 is a magnified sectional view of portions of the system of FIG. 1, taken along the line A-A in FIG. 7.

More specifically, as seen, for example, in FIGS. 8 and 12, each coupling bracket 142, 144, 146, 148 includes an elongated female-threaded aperture 150 for receiving a male-threaded portion 152 of the corresponding adjustment member, and a coupling bracket 154 (also referred to as a coupling bracket member) extending, outside receiving channel 114, between the female-threaded aperture and one of the parallel members of the corresponding mounting bracket. In each case, the coupling bracket is attached to the associated parallel member by a pin 156 passing through a circular aperture 158 in the coupling bracket, and also passing through a diagonal, elongated slot 160 in the parallel member. In FIG. 7, the pin associated with the coupling bracket of coupling bracket 148 has been omitted to better show circular aperture 158 and its alignment with slot 160.

To connect planar member 122 of body portion 120 with opposing parallel members 110, 112 of mounting brackets 102, a horizontal, elongated slot 162 is formed in each opposing parallel member of the mounting brackets, and each pair of opposing parallel members is attached to the planar member of the body portion by a pin 164 passing through one of the elongated slots 162 and also through a corresponding circular aperture 166 in the planar member. See, for example, FIGS. 6-11. This structure provides rotational stability of the planar member (and thus of the entire wall panel support mechanism) with respect to the mounting brackets, by preventing any inadvertent rotation of the wall panel support mechanism and only allowing intentional movements caused by the adjustment members.

As a result of the attachment structure of each coupling bracket to an associated parallel member of the corresponding mounting bracket, rotation of each adjustment member relative to the corresponding coupling bracket causes the body portion to move toward or away from the plane defined by the wall mounting portion of the corresponding mounting bracket, and is thereby configured to cause a corresponding region of a mounted wall panel to move toward or away from the wall frame.

More specifically, due to the coupling through the diagonal slots 160, rotation of one of the adjustment members attached to a coupling bracket causes the coupling bracket to move in a diagonal path relative to the associated mounting bracket, allowing inward an outward adjustments of the coupling brackets and thus of different portions of an installed wall panel.

Wall panel attachment member 106 can take many forms, provided it is configured to be directly or indirectly attached to the adjustable wall panel support mechanism, and to support a wall panel. In this example, wall panel attachment member is shown in the form of a particular hook plate.

Figure 11:
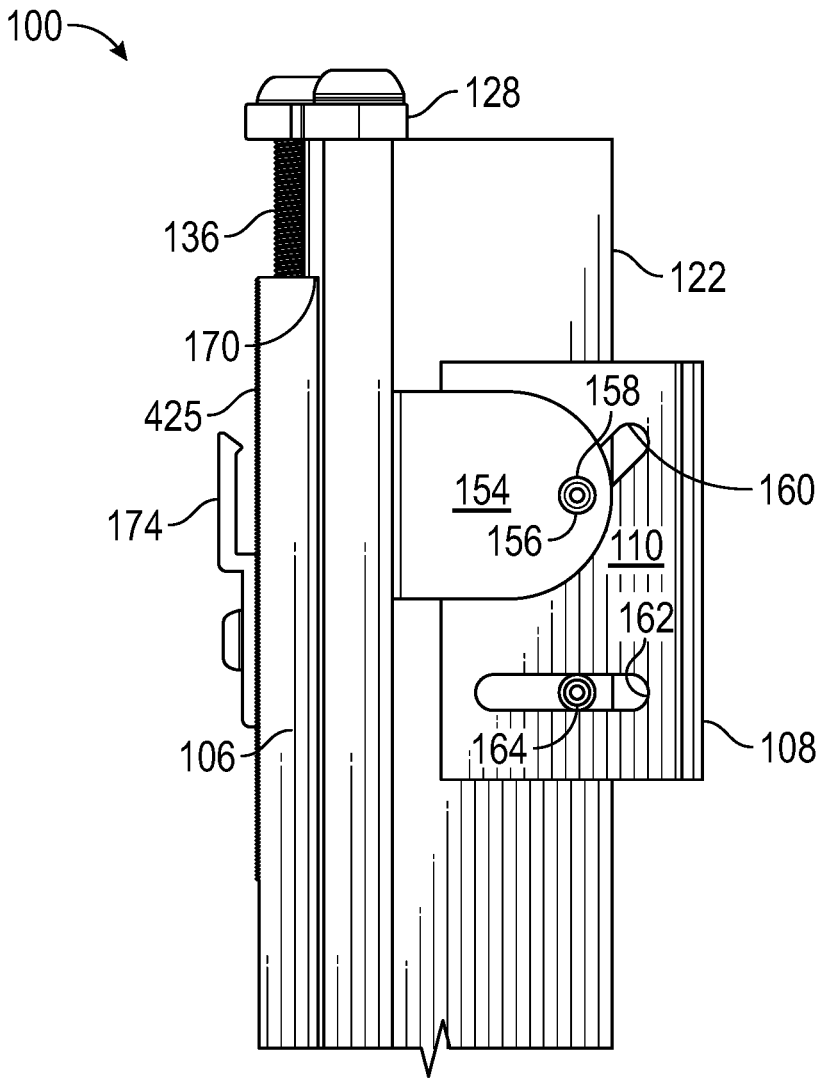
FIG. 11 is a magnified right side elevational view of a top portion of the system of FIG. 1.

Details of hook plate 106 can be seen, for example, in FIG. 1 and in FIGS. 10-12. Hook plate 106 is attached to adjustable wall panel support mechanism 104 by vertical adjustment member 136, which passes through an aperture in the lateral center of top plate 128. Adjustment member 136, which is externally threaded, passes into an internally threaded (or partially internally threaded) receiving channel 168 formed in the hook plate. Thus, rotation of adjustment member 136 causes the hook plate to move parallel to the planes defined by the wall mounting portions (i.e., vertically up or down relative to the mounting brackets), and is thereby configured to cause a mounted wall panel to move vertically up or down relative to mounting brackets and the wall frame, without any inward or outward motion of the wall panel.

Hook plate 106 is also attached to body portion 120, and specifically to side portions 124, 126 of the body portion, in sliding engagement. More specifically, overlapping edge portions 170, 172 of the hook plate (see, e.g., FIGS. 10 and 12) define grooves within which side portions 124, 126 are disposed, retaining the hook plate in a constant orientation parallel to side portions 124, 126, while allowing the hook plate to slide up and down when adjustment member 136 is rotated.

As can be seen, for example, in FIGS. 1, 6, 7 and 10, one or more z-clips 174 may be mounted to hook plate 106. Z-clips 174 are configured to mate with a complementary z-clip attached to a wall panel, and thus provide a mechanism to support the wall panel in with its back surface in close proximity with the hook plate. Many other types of panel support hardware can be attached to the hook plate and used to support a wall panel in place of z-clips. For example, one or more rigid horizontal rods may be attached to a hook plate, and complementary hooks attached to the wall panel can be used to couple the wall panel to the hook plate. In some cases, the hook plate will vary in design to accommodate a specific type of panel mounting hardware. A wide variety of mechanisms for attaching wall panels to a surface may be used in conjunction with the present teachings.

Example 2

Figure 13:
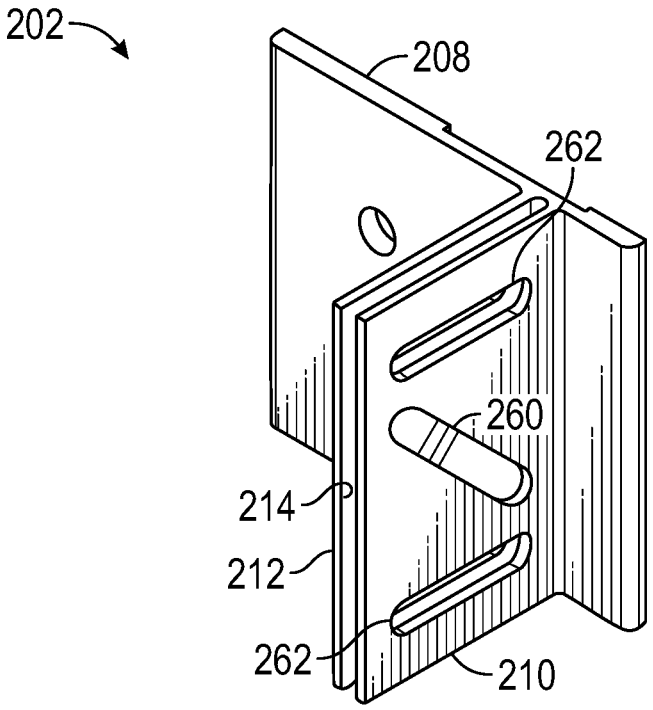
FIG. 13 is a perspective view of a mounting bracket embodiment that may be used in a wall panel mounting system, according to aspects of the present teachings.
Figure 14:
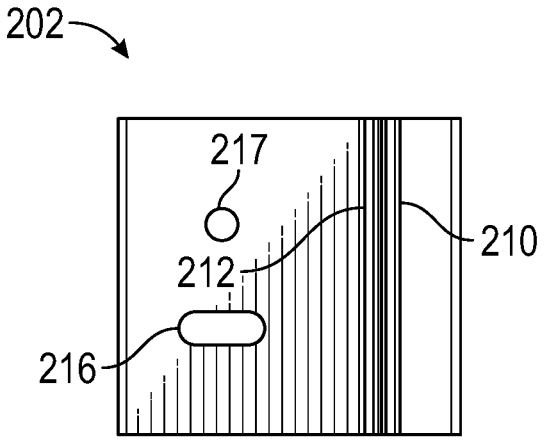
FIG. 14 is a front elevational view of the mounting bracket of FIG. 13.

This example describes another exemplary wall mounting bracket that can be used in conjunction with systems according to the present teachings; see FIGS. 13-14.

FIGS. 13-14 show a wall mounting bracket, generally indicated at 202, which can be used in place of wall mounting brackets 102. Wall mounting bracket 202 includes a wall mounting portion 208 defining a plane and configured to be fixed to a wall frame, and a pair of opposing parallel members 210, 212 extending perpendicularly away from the plane of the wall mounting portion and defining a narrow receiving channel 214 between parallel members 210, 212. This is generally similar to the structure of wall mounting brackets 102.

However, whereas the wall mounting portions of mounting brackets 102 (see, e.g., FIG. 12) extend symmetrically away from the opposing parallel members, in this example the wall mounting portion extends away from the opposing parallel members 210, 212 by different distances on each side of the opposing parallel members, thereby defining an L-shaped mounting bracket.

Apertures 216, 217 are formed in wall mounting portion 208 to facilitate the attachment of the mounting bracket to a wall frame or other desired surface. These apertures can take any desired shape and size. In this example, due to the small amount of the wall mounting portion extending to one side of opposing parallel members 210, 212 (the right side, in FIGS. 13-14), two apertures are formed on the other side of the opposing parallel members (the left side, in FIGS. 13-14). This allows the mounting bracket to be attached to the wall frame at two points, creating rotational stability of the mounting bracket.

In this example, a diagonal, elongated slot 260 is formed in each of opposing parallel members 210, 212, and furthermore, two horizontal, elongated slots 262 formed in each of opposing parallel members 210, 212 (rather than just one, as in the previous example). This allows mounting plate 202 to be used in either left-hand or right-hand corners of a structure. For example, in the orientation shown in FIGS. 13-14, mounting plate 202 can be used in a right-hand corner. To use mounting plate 202 in a left-hand corner, it can be flipped upside down, i.e., rotated 180 degrees around an axis out of the page in FIG. 14. In either case, there will be a horizontal slot 262 disposed below diagonal slot 260.

Aside from the distinctions described above, mounting plate 202 can be integrated into the same system described previously with respect to mounting plate 102. Accordingly, the previous description of the remaining components of the system remains the same, and those remaining components will not be described again here.

Example 3

Figure 15:
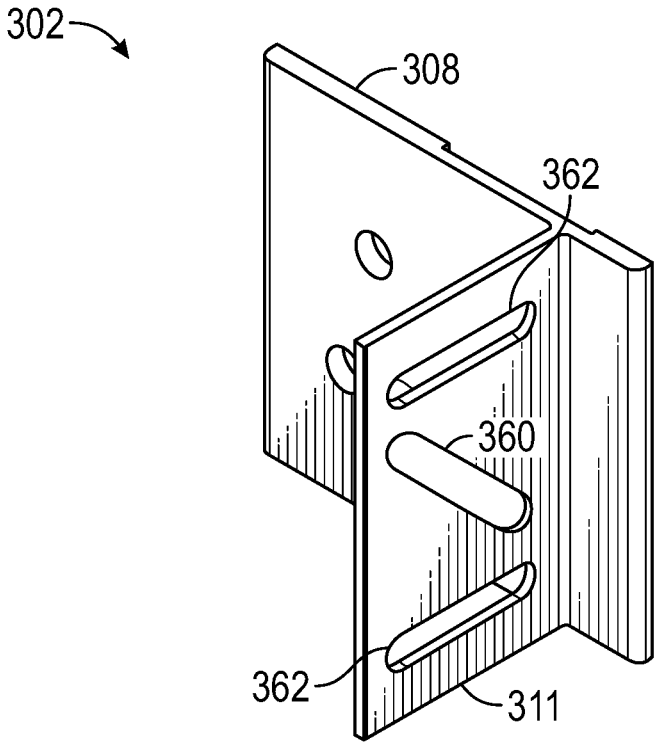
FIG. 15 is a perspective view of another mounting bracket embodiment that may be used in a wall panel mounting system, according to aspects of the present teachings.
Figure 16:
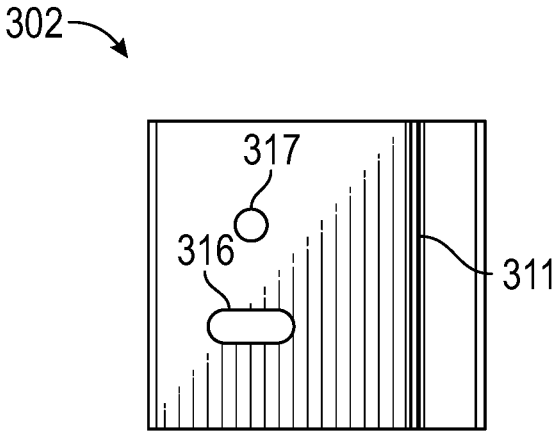
FIG. 16 is a front elevational view of the mounting bracket of FIG. 15.

This example describes yet another exemplary wall mounting bracket that can be used in conjunction with systems according to the present teachings; see FIGS. 15-16.

FIGS. 15-16 show a wall mounting bracket, generally indicated at 302, which can be used in place of wall mounting brackets 102 or 202. Wall mounting bracket 302 includes a wall mounting portion 308 defining a plane and configured to be fixed to a wall frame, and a receiving member 311 extending perpendicularly away from the plane of the wall mounting portion. This structure differs from the previous examples in that a single receiving member is used with each mounting bracket, rather than a pair of parallel members forming a narrow channel.

The use of mounting bracket 302 differs from the use of mounting bracket 102 or 202 in that the planar member of the wall panel support mechanism, rather than fitting within the channels of each of the mounting brackets 102 or 202, instead is configured to fit flush against the receiving members 311 of each of the mounting brackets 302. Because the planar member is not sandwiched between two opposing surfaces, care must be taken to secure the planar member and the receiving member together in a manner that provides lateral stability, such as (for example) double-headed rivets or some other fastener that prevents the planar member and the receiving member from becoming separated. However, the simpler design of a single receiving member, rather than a pair of parallel members, may save material costs and/or manufacturing costs.

As is the case for mounting bracket 202, in this example the wall mounting portion 308 of mounting bracket 302 extends away from receiving member 311 by different distances on each side of the receiving member, thereby defining an L-shaped mounting bracket. However, a singular receiving member also may be used in place of parallel members forming a channel in symmetric, T-shaped mounting brackets.

The remaining features of mounting bracket 302 are similar to the features of mounting bracket 202. Apertures 316, 317 are formed in wall mounting portion 308 to facilitate the attachment of the mounting bracket to a wall frame or other desired surface. Due to the small amount of the wall mounting portion extending to one side of opposing receiving member 311 (the right side, in FIGS. 15-16), two apertures are formed on the other side of the receiving member 311 (the left side, in FIGS. 15-16). This provides two-point attachment of the mounting bracket to a wall frame, creating rotational stability of the mounting bracket.

A diagonal, elongated slot 360 and two horizontal, elongated slots 362 are formed in receiving member 311. This allows mounting plate 302 to be used in either left-hand or right-hand corners of a structure. For example, in the orientation shown in FIGS. 15-16, mounting plate 302 can be used in a right-hand corner. To use mounting plate 302 in a left-hand corner, it can be rotated 180 degrees around an axis out of the page in FIG. 16. In either case, there will be a horizontal slot 362 disposed below diagonal slot 360.

Aside from the distinctions described above, mounting plate 302 can be integrated into the same system described previously with respect to mounting plate 102. Accordingly, the previous description of the remaining components of the system remains the same, and those remaining components will not be described again here.

Example 4

Figure 17:
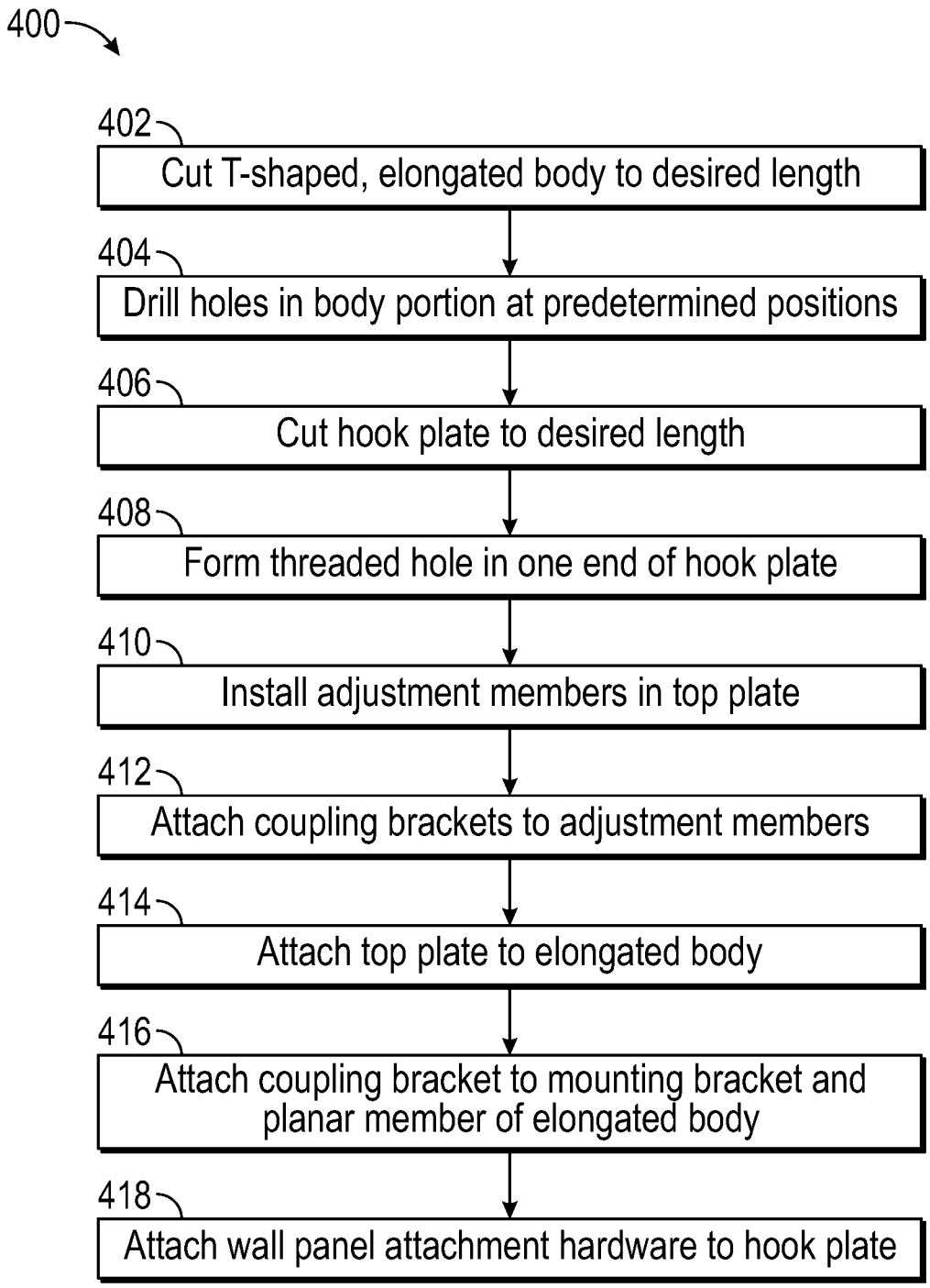
FIG. 17 is a flow chart illustrating possible steps in an embodiment of a method of assembling a wall panel adjustment system, according to aspects of the present disclosure.

This example describes a method for assembling a wall panel mounting system, according to aspects of the present teachings; see FIG. 17. Wall panel mounting systems, and components thereof, of the type described above may be utilized in the method steps described below. Where appropriate, reference may be made to previously described components and systems that may be used in carrying out each step. These references are for illustration, and are not intended to limit the possible ways of carrying out any particular step of the method.

FIG. 17 is a flowchart illustrating operations performed in an exemplary method of assembling a wall panel adjustment system, and may not recite the complete process or all steps of the method. FIG. 17 depicts multiple steps of a method of assembly, generally indicated at 400, which may be performed in conjunction with the components of a wall panel adjustment system, according to aspects of the present disclosure. Although various steps of method 400 are described below and depicted in FIG. 17, the steps need not necessarily all be performed, and in some cases may be performed in a different order than the order shown.

At step 402, a generally T-shaped, elongated body portion of indeterminate size is cut to a desired length. At step 404, holes are drilled in the body portion at positions corresponding to predetermined positions for mounting bracket support pins. At step 406, a hook plate is cut to a desired length. At step 408, a threaded hole is formed in one end of the hook plate. At step 410, a plurality of elongated adjustment members are installed in a top plate. At step 412, a coupling bracket is attached in threaded engagement with each of the adjustment members. At step 414, the top plate is attached to a top of the elongated body. At step 416, each coupling bracket is attached in unthreaded engagement both to a mounting bracket and also to a planar member of the elongated body. This will generally be accomplished using pins, rivets, or similar fasteners passing through aligned apertures in the mounting bracket, the coupling bracket and the planar member of the elongated body. At step 418, wall panel attachment hardware, such as z-clips, are attached to the hook plate.

The mounting bracket, the coupling bracket and the planar member will be attached to each other in a manner that allows inward and outward motions of the hook plate relative to the back surface of the mounting plate, such as a pin extending through a circular aperture in the coupling bracket and a diagonal slot formed in the mounting bracket. To provide rotational stability, the mounting bracket and the planar member also may be attached to each other through a circular aperture in the coupling bracket and a horizontal slot in the mounting bracket. For example, FIGS. 6-11 depict one suitable manner for connecting the mounting bracket, the coupling bracket and the planar member.

Prior to assembly, the components of the systems described herein may be formed of any suitable materials, depending on the requirements of a particular application. For example, mounting relatively heavy wall panels may require a mounting system in which most, or all, of the components are made of metal, whereas mounting systems for mounting relatively lightweight wall panels may include components constructed from other materials such as composite materials, carbon materials, or plastics, among others. In some cases, one or more components of the disclosed systems may be formed or partially formed in an extrusion process. For example, the elongated body portion of a wall panel support mechanism and/or the hook plate may be formed from extruded aluminum and then cut to length by a supplier or by the user.

The small teeth 425 (see FIGS. 10-11) formed on front portions of the hook plate provide friction with a z-clip or other hardware, which may be provided with complementary teeth. Teeth 425 can be formed, for example, by a roller upon which the pattern of teeth is disposed. The roller, which is formed of a harder material than the material of the hook plate, can then be used in a pinch-roll or similar rolling process to imprint the pattern on the front of the hook plate.

Example 5

This section describes additional aspects and features of wall panel mounting systems and methods, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A. A system for mounting a wall panel to a wall frame, comprising:

first and second mounting brackets, each mounting bracket including:

a wall mounting portion defining a plane and configured to be fixed to a wall frame, and a pair of opposing parallel members extending perpendicularly away from the plane of the wall mounting portion and defining a narrow receiving channel;

an adjustable wall panel support mechanism including:

an elongated body portion having a planar member configured to fit within the receiving channels of the mounting brackets, with the planar member sandwiched between the opposing parallel members, and a pair of side portions extending in opposite directions perpendicular to the planar member;

a top plate configured to be rigidly attached to one end of the body portion;

a first elongated adjustment member passing through a first aperture in the top plate and extending toward the first mounting bracket;

a first coupling bracket attached in threaded engagement with the first adjustment member and attached in unthreaded engagement with the first mounting bracket;

a second elongated adjustment member passing through a second aperture in the top plate and extending toward the second mounting bracket; and a second coupling bracket attached in threaded engagement with the second adjustment member and attached in unthreaded engagement with the second mounting bracket; and a wall panel attachment member operatively coupled to the wall panel support mechanism and configured to support a wall panel;

wherein rotation of the first adjustment member causes the body portion to move toward or away from the plane defined by the wall mounting portion of the first mounting bracket, and rotation of the second adjustment member causes the body portion to move toward or away from the plane defined by the wall mounting portion of the second mounting bracket.

A1. The system of claim A, wherein each coupling bracket includes a female-threaded aperture for receiving a male-threaded portion of the corresponding adjustment member and a coupling bracket extending between the female-threaded aperture and one of the parallel members of the corresponding mounting bracket, and wherein the coupling bracket is attached to the parallel member by a pin passing through a circular aperture in the coupling bracket and also passing through a diagonal, elongated slot in the parallel member.

A2. The system of claim A1, wherein a horizontal, elongated slot is formed in each opposing parallel member of the mounting brackets, and each pair of opposing parallel members is further attached to the planar member of the body portion by a pin passing through the elongated slots and also through a corresponding circular aperture in the planar member.

A3. The system of claim A, further comprising a vertical adjustment member passing through the top plate and connected to the wall panel attachment member by threaded engagement, wherein rotation of the vertical adjustment member causes the wall panel attachment member to move parallel to the planes defined by the wall mounting portions, and is thereby configured to cause a mounted wall panel to move vertically up or down relative to the wall frame.

A4. The system of claim A3, wherein the wall panel attachment member is a hook plate, wherein the vertical adjustment member is attached to the hook plate in threaded engagement, and the body portion is attached to the hook plate in sliding engagement.

A5. The system of claim A4, wherein at least one z-clip is mounted to the hook plate and is configured to mate with a complementary z-clip attached to a wall panel.

A6. The system of claim A, further comprising a thermal break formed along a back surface of the wall mounting portion of each mounting bracket.

B. A system for mounting a wall panel to a wall frame, comprising:

a plurality of mounting brackets, each including:

a substantially planar wall mounting portion configured to be fixed to a wall frame, and a pair of opposing parallel members extending away from wall mounting portion in a direction perpendicular to a plane defined by the wall mounting portion and defining a narrow channel;

an adjustable wall panel support mechanism, including:

an elongated body portion having a fin-like planar member extending along the body portion and configured to fit within the channels of each of the mounting brackets, with the planar member sandwiched between and in contact with the opposing parallel members of each of the mounting brackets;

a top plate configured to be rigidly attached to one end of the body portion;

a plurality of elongated adjustment members each passing through the top plate and extending toward a corresponding one of the mounting brackets; and a plurality of coupling brackets each attached in threaded engagement with one of the adjustment members and in unthreaded engagement with the corresponding mounting bracket; and a wall panel attachment member operatively attached to the body portion and configured to support the wall panel;

wherein rotation of each adjustment member relative to the corresponding coupling bracket causes the body portion to move toward or away from the plane defined by the wall mounting portion of the corresponding mounting bracket, and is thereby configured to cause a corresponding region of the wall panel to move toward or away from the wall frame.

B1. The system of claim B, wherein each wall mounting portion extends symmetrically away from the opposing parallel members, thereby defining T-shaped mounting brackets.

B2. The system of claim B, wherein each wall mounting portion extends away from the opposing parallel members by different distances on each side of the opposing parallel members, thereby defining L-shaped mounting brackets.

B3. The system of claim B, further comprising a vertical adjustment member passing through the top plate and connected to the wall panel attachment member by threaded engagement, wherein rotation of the vertical adjustment member causes the wall panel attachment member to move parallel to the planes defined by the wall mounting portions, and is thereby configured to cause a mounted wall panel to move vertically up or down relative to the wall frame.

B4. The system of claim B3, wherein the wall panel attachment member is a hook plate, the vertical adjustment member is attached to the hook plate in threaded engagement, and the body portion is attached to the hook plate in sliding engagement.

B5. The system of claim B, wherein each coupling bracket includes an elongated female-threaded aperture for receiving a male-threaded portion of the corresponding adjustment member, and a coupling bracket extending between the female-threaded aperture and one of the parallel members of the corresponding mounting bracket, and wherein the coupling bracket is attached to the parallel member by a pin passing through a circular aperture in the coupling bracket and also passing through a diagonal, elongated slot in the parallel member.

C. A system for adjustably mounting a wall panel to a wall frame, comprising:

at least two mounting brackets, each including:

a wall mounting portion configured to be fixed to the wall frame, and at least one receiving member extending perpendicularly away from the wall mounting portion;

an adjustable wall panel support mechanism, including:

an elongated body portion having a planar member extending along the body portion and configured to fit flush against the receiving members of each of the mounting brackets;

a top plate configured to be rigidly attached to one end of the body portion;

at least two elongated adjustment members, each passing through the top plate and each extending toward a corresponding one of the mounting brackets; and at least two coupling brackets, each attached in threaded engagement with a corresponding one of the adjustment members and in unthreaded engagement with a corresponding one of the mounting brackets; and a hook plate attached to the body portion and configured to support the wall panel;

wherein rotation of each adjustment member relative to the corresponding coupling bracket causes the body portion to move toward or away from a plane defined by the wall mounting portion of the corresponding mounting bracket, and is thereby configured to cause a corresponding region of a mounted wall panel to move toward or away from the wall frame.

C1. The system of claim C, wherein the at least one receiving member includes a pair of parallel receiving members forming a narrow slot, and wherein the planar member is configured to fit within the narrow slot of each mounting bracket, in physical contact with an inner surface of each receiving member.

C2. The system of claim C1, further comprising a low-friction coating disposed on the planar member, the inner surfaces of the receiving members, or both.

C3. The system of claim C, further comprising a vertical adjustment member passing through the top plate and connected to the hook plate by threaded engagement, wherein rotation of the vertical adjustment member causes the hook plate to move parallel to the planes defined by the wall mounting portions, and is thereby configured to cause a mounted wall panel to move vertically up or down relative to the wall frame.

C4. The system of claim C3, wherein the vertical adjustment member is attached to the hook plate in threaded engagement, and the body portion is attached to the hook plate in sliding engagement.

C5. The system of claim C4, further comprising a plurality of z-clips rigidly attached to the hook plate and configured to mate with complementary z-clips attached to a wall panel.

C6. The system of claim C, further comprising a thermal break formed along a back surface of the wall mounting portion of each mounting bracket.

Manner of Operation/Use

This section described the practical use of system 100, irrespective of which mounting bracket is used or the precise method of assembling the system. First, system 100 is assembled to have a desired height (or length) and number of mounting brackets. Typical examples include two or four mounting brackets. The system is then installed in a desired approximate location on a wall frame, by attaching the wall mounting portions of the mounting brackets to the wall frame. The location is chosen to provide a starting point for the position of a subsequently mounted wall panel which is close to the desired final position of the panel.

Attaching the mounting brackets to the wall frame will typically be accomplished with fasteners passing through apertures in the wall mounting portion of each mounting bracket and into the wall frame. However, this attachment can also be accomplished in other ways. For example, the mounting brackets may be glued, soldered, welded, or otherwise attached to the wall frame.

Next, a wall panel is attached to the hook plate (or more generally, to the wall panel attachment member). In a system using z-clips, for example, the wall panel may be positioned with its z-clips above the z-clips of the hook plate, and then slid downward into position.

Once the wall panel is secured to the hook plate, fine adjustments may be made to the position and orientation of the wall panel using the adjustment members in the top plate of the support mechanism. Specifically, the laterally positioned adjustment member may be rotated to cause inward and outward motions of the wall panel at the locations of the corresponding coupling brackets, to adjust the tilt of the wall panel and/or its spacing away from the wall frame. The center adjustment member may be rotated to adjust the overall vertical position of the wall panel relative to the wall frame.

The positions of the various adjustment members in the top plate may vary in some embodiments.

The positions of any subsequently installed wall panels can be adjusted in the same manner, resulting in a wall comprised of an array of precisely aligned wall panels. Systems according to the present disclosure can be used to install all types of wall panels, some of which may be known in the building industry as "wall finishes." The size, weight, and decorative properties of such panels can vary widely while still remaining compatible with the presently disclosed systems. Further, the portion of the building to which wall panels are attached with the presently disclosed systems can also vary widely. For example, the mounting brackets of the present systems can be attached to structural components such as wall frame studs or concrete walls, or to non-structural architectural features, or even to preexisting walls or wall panels.

Advantages, Features, Benefits

The different embodiments of the wall panel mounting systems described herein provide several advantages over known solutions for mounting wall panels to a wall frame or other surface in an adjustable manner. For example, the illustrative embodiments of the wall panel mounting systems described herein allow precise adjustment in the position and orientation of a wall panel, without requiring access to the space behind the panel and without requiring the panel to be un-mounted to make adjustments.

Additionally, and among other benefits, illustrative embodiments of the wall panel mounting systems described herein allow insulation to be installed behind wall panels with virtually no uninsulated space, because the insulation can be disposed everywhere except in the space occupied by the opposing parallel members 110, 112 and the channels 114 they form or, in the case of mounting bracket 302, everywhere except in the space occupied by receiving member 311. Furthermore, illustrative embodiments of the wall panel mounting systems described herein may be lighter, require less materials, and be less expensive to manufacture and ship than previously known solutions. However, not all embodiments described herein provide the same advantages or the same degree of advantage.

Conclusion

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

I claim:

1. A system for mounting a wall panel to a wall frame, comprising:

first and second mounting brackets, each mounting bracket including:

a wall mounting portion defining a plane and configured to be fixed to a wall frame, and a pair of opposing parallel members extending perpendicularly away from the plane of the wall mounting portion and defining a narrow receiving channel;

an adjustable wall panel support mechanism including:

an elongated body portion having a planar member configured to fit within the receiving channels of the mounting brackets, with the planar member sandwiched between the opposing parallel members, and a pair of side portions extending in opposite directions perpendicular to the planar member;

a top plate configured to be rigidly attached to one end of the body portion;

a first elongated adjustment member passing through a first aperture in the top plate and extending toward the first mounting bracket;

a first coupling bracket attached in threaded engagement with the first adjustment member and attached in unthreaded engagement with the first mounting bracket;

a second elongated adjustment member passing through a second aperture in the top plate and extending toward the second mounting bracket; and a second coupling bracket attached in threaded engagement with the second adjustment member and attached in unthreaded engagement with the second mounting bracket; and a wall panel attachment member operatively coupled to the wall panel support mechanism and configured to support a wall panel;

wherein rotation of the first adjustment member causes the body portion to move toward or away from the plane defined by the wall mounting portion of the first mounting bracket, and rotation of the second adjustment member causes the body portion to move toward or away from the plane defined by the wall mounting portion of the second mounting bracket;

wherein each coupling bracket includes a coupling bracket member extending outside the receiving channel and attached to one of the parallel members of the corresponding mounting bracket by a pin passing through an aperture in the coupling bracket member and also passing through a slot in the parallel member.

2. The system of claim 1, wherein a horizontal, elongated slot is formed in each opposing parallel member of the mounting brackets, and each pair of opposing parallel members is further attached to the planar member of the body portion by a pin passing through the elongated slots and also through a corresponding circular aperture in the planar member.

3. The system of claim 1, further comprising a vertical adjustment member passing through the top plate and connected to the wall panel attachment member by threaded engagement, wherein rotation of the vertical adjustment member causes the wall panel attachment member to move parallel to the planes defined by the wall mounting portions, and is thereby configured to cause a mounted wall panel to move vertically up or down relative to the wall frame.

4. The system of claim 3, wherein the wall panel attachment member is a hook plate, wherein the vertical adjustment member is attached to the hook plate in threaded engagement, and the body portion is attached to the hook plate in sliding engagement.

5. The system of claim 4, wherein at least one z-clip is mounted to the hook plate and is configured to mate with a complementary z-clip attached to a wall panel.

6. The system of claim 1, further comprising a thermal break formed along a back surface of the wall mounting portion of each mounting bracket.

7. A system for mounting a wall panel to a wall frame, comprising:

a plurality of mounting brackets, each including:

a substantially planar wall mounting portion configured to be fixed to a wall frame, and a pair of opposing parallel members extending away from wall mounting portion in a direction perpendicular to a plane defined by the wall mounting portion and defining a narrow channel;

an adjustable wall panel support mechanism, including:

an elongated body portion having a fin-like planar member extending along the body portion and configured to fit within the channels of each of the mounting brackets, with the planar member sandwiched between and in contact with the opposing parallel members of each of the mounting brackets;

a top plate configured to be rigidly attached to one end of the body portion;

a plurality of elongated adjustment members each passing through the top plate and extending toward a corresponding one of the mounting brackets; and a plurality of coupling brackets each attached in threaded engagement with one of the adjustment members and in unthreaded engagement with the corresponding mounting bracket; and a wall panel attachment member operatively attached to the body portion and configured to support the wall panel;

wherein rotation of each adjustment member relative to the corresponding coupling bracket causes the body portion to move toward or away from the plane defined by the wall mounting portion of the corresponding mounting bracket, and is thereby configured to cause a corresponding region of the wall panel to move toward or away from the wall frame; and wherein each coupling bracket includes a coupling bracket member extending outside the channel and attached to one of the parallel members of the corresponding mounting bracket by a pin passing through a circular aperture in the coupling bracket member and also passing through an elongated slot in the parallel member.

8. The system of claim 7, wherein each wall mounting portion extends symmetrically away from the opposing parallel members, thereby defining T-shaped mounting brackets.

9. The system of claim 7, wherein each wall mounting portion extends away from the opposing parallel members by different distances on each side of the opposing parallel members, thereby defining L-shaped mounting brackets.

10. The system of claim 7, further comprising a vertical adjustment member passing through the top plate and connected to the wall panel attachment member by threaded engagement, wherein rotation of the vertical adjustment member causes the wall panel attachment member to move parallel to the planes defined by the wall mounting portions, and is thereby configured to cause a mounted wall panel to move vertically up or down relative to the wall frame.

11. The system of claim 10, wherein the wall panel attachment member is a hook plate, the vertical adjustment member is attached to the hook plate in threaded engagement, and the body portion is attached to the hook plate in sliding engagement.

12. A system for adjustably mounting a wall panel to a wall frame, comprising:

at least two mounting brackets, each including:

a wall mounting portion configured to be fixed to the wall frame, and a pair of parallel receiving members extending perpendicularly away from the wall mounting portion and forming a narrow slot;

at least one adjustable wall panel support mechanism, each including:

an elongated body portion having a planar member extending along the body portion and configured to fit flush against the receiving members of each of the mounting brackets;

a top plate configured to be rigidly attached to one end of the body portion;

at least two elongated adjustment members, each passing through the top plate and each extending toward a corresponding one of the mounting brackets; and at least two coupling brackets, each attached in threaded engagement with a corresponding one of the adjustment members and in unthreaded engagement with a corresponding one of the mounting brackets; and means for supporting the wall panel;

wherein rotation of each adjustment member relative to the corresponding coupling bracket causes the body portion to move toward or away from a plane defined by the wall mounting portion of the corresponding mounting bracket, and is thereby configured to cause a corresponding region of a mounted wall panel to move toward or away from the wall frame; and wherein the planar member is configured to fit within the narrow slot of each mounting bracket, and the coupling brackets are disposed outside the narrow slot.

13. The system of claim 12, further comprising a low-friction coating disposed on the planar member, the inner surfaces of the receiving members, or both.

14. The system of claim 12, wherein the means for supporting the wall panel includes a hook plate, and further comprising a vertical adjustment member passing through the top plate and connected to the hook plate by threaded engagement, wherein rotation of the vertical adjustment member causes the hook plate to move parallel to the planes defined by the wall mounting portions, and is thereby configured to cause a mounted wall panel to move vertically up or down relative to the wall frame.

15. The system of claim 14, wherein the vertical adjustment member is attached to the hook plate in threaded engagement, and the body portion is attached to the hook plate in sliding engagement.

16. The system of claim 15, further comprising a plurality of z-clips rigidly attached to the hook plate and configured to mate with complementary z-clips attached to a wall panel.

17. The system of claim 12, further comprising a thermal break formed along a back surface of the wall mounting portion of each mounting bracket.

18. The system of claim 12, wherein each wall mounting portion extends symmetrically away from the corresponding parallel receiving members, thereby defining T-shaped mounting brackets.

19. The system of claim 12, wherein each wall mounting portion extends away from the corresponding parallel receiving members by different distances, thereby defining L-shaped mounting brackets.

20. The system of claim 12, wherein the at least two mounting brackets includes four mounting brackets and the at least one adjustable wall panel support mechanism includes two adjustable wall panel support mechanisms, two of the mounting brackets include wall mounting portions extending symmetrically away from the corresponding parallel receiving members, thereby defining T-shaped mounting brackets, and two of the mounting brackets include wall mounting portions extending away from the corresponding parallel receiving members by different distances, thereby defining L-shaped mounting brackets.

* * * * *